US010370779B2

(12) United States Patent
Ricaurte-Rubio et al.

(10) Patent No.: US 10,370,779 B2
(45) Date of Patent: Aug. 6, 2019

(54) AIR SPINNING MACHINE ALONG WITH A METHOD FOR OPERATING THE SAME

(71) Applicant: Maschinenfabrik Rieter AG, Winterthur (CH)

(72) Inventors: Javier-Orlando Ricaurte-Rubio, Gingen (DE); Simon-Moritz Funke, Laichingen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 254 days.

(21) Appl. No.: 15/357,206

(22) Filed: Nov. 21, 2016

(65) Prior Publication Data

US 2017/0145601 A1 May 25, 2017

(30) Foreign Application Priority Data

Nov. 25, 2015 (DE) ..... 10 2015 120 437

(51) Int. Cl.
*D01H 13/30* (2006.01)
*D01H 1/115* (2006.01)

(52) U.S. Cl.
CPC ..... *D01H 13/306* (2013.01); *D01H 1/115* (2013.01)

(58) Field of Classification Search
CPC ..... D01H 1/115; D01H 13/306
See application file for complete search history.

(56) References Cited

U.S. PATENT DOCUMENTS 3,601,967 A * 8/1971 Wardley ..... H01B 13/323 156/48
3,783,596 A * 1/1974 Waldkirch ..... D06B 1/08 28/272
9,290,863 B2 * 3/2016 Gotz ..... D01H 1/115
9,670,600 B2 6/2017 Schäffler et al.
(Continued)

FOREIGN PATENT DOCUMENTS

DE 10 2012 100674 A1 8/2013
EP 2 450 478 A2 5/2012
(Continued)

OTHER PUBLICATIONS

German Search Report dated Sep. 22, 2016.
EP Search Report, dated May 22, 2017.

*Primary Examiner* — Shaun R Hurley
(74) *Attorney, Agent, or Firm* — Dority & Manning, P.A.

(57) ABSTRACT

A method is provided for operating an air spinning machine with a multiple number of spinning units, whereas each spinning unit has a spinning nozzle with an internal vortex chamber. The spinning nozzle is fed a fiber composite during the operation of the spinning unit. The spinning nozzle has a multiple number of air nozzles leading into the vortex chamber through which compressed air streams into the vortex chamber in order to generate a vortex air flow within the vortex chamber. The fiber composite receives a twist with the assistance of the vortex air flow within the vortex chamber such that a yarn is formed from the fiber composite. The air spinning machine features an additive supply, whereby an additive is at least temporarily fed a part of the spinning units. A liquid additive is used, whereas the additive is degassed prior to leaving the additive supply. In addition, an air spinning machine with a degassing device is described.

15 Claims, 2 Drawing Sheets

(56) References Cited

U.S. PATENT DOCUMENTS

| | | | | |
|---|---|---|---|---|
| 2002/0108364 | A1* | 8/2002 | Xavier | B21C 37/127 57/6 |
| 2004/0026818 | A1 | 2/2004 | Klein et al. | |
| 2007/0117215 | A1* | 5/2007 | Davis | G01N 21/643 436/172 |
| 2011/0274795 | A1* | 11/2011 | Bogue | A61K 9/7007 426/231 |
| 2015/0283746 | A1 | 10/2015 | Schaffler et al. | |
| 2015/0284878 | A1 | 10/2015 | Kübler et al. | |

FOREIGN PATENT DOCUMENTS

| | | | |
|---|---|---|---|
| EP | 2 767 625 | A1 | 8/2014 |
| EP | 2 927 353 | A2 | 10/2015 |
| EP | 2 927 355 | A2 | 10/2015 |
| EP | 2 944 713 | A1 | 11/2015 |
| JP | 2008095208 | | 4/2008 |
| WO | WO 02/50348 | | 6/2002 |

* cited by examiner

AIR SPINNING MACHINE ALONG WITH A METHOD FOR OPERATING THE SAME

FIELD OF THE INVENTION

The present invention relates to a method for operating an air spinning machine with a multiple number of spinning units, whereas each spinning unit comprises at least one spinning nozzle with an internal vortex chamber. The spinning nozzle is fed a fiber composite through an inlet during operation of the spinning unit. The spinning nozzle features a multiple number of air nozzles leading into the vortex chamber, through which, during the operating of the air spinning machine, compressed air streams into the vortex chamber in order to generate a vortex air flow within the vortex chamber. The fiber composite receives a twist with the assistance of the vortex air flow within the vortex chamber, such that a yarn is formed from the fiber composite, which ultimately leaves the spinning nozzle through an outlet. The air spinning machine features an additive supply, with the assistance of which, during the operation of the air spinning machine, an additive is at least temporarily fed to at least one part of the spinning units.

Furthermore, an air spinning machine with multiple spinning units is described, whereas each spinning unit comprises at least one spinning nozzle, which serves to produce a yarn from a fiber composite fed to the spinning unit. The spinning nozzle features an inlet for the fiber composite, an inner vortex chamber, a yarn formation element protruding into the vortex chamber, along with an outlet for the yarn produced inside the vortex chamber. The spinning nozzle features a multiple number of air nozzles leading into the vortex chamber, through which, during the operating of the air spinning machine, compressed air streams into the vortex chamber, in order to generate a vortex air flow within the vortex chamber. The air spinning machine features an additive supply that is formed to, at least temporarily, supply at least one part of the spinning units with a liquid additive.

BACKGROUND

Air spinning machines with corresponding spinning units are known in the state of the art, and serve the purpose of producing a yarn from an elongated fiber composite. At this, the outer fibers of the fiber composite are, with the assistance of a vortex air flow generated by the air nozzles within the vortex chamber in the area of the inlet mouth of the yarn formation element, wound around the internal core fibers, and ultimately form the winding fibers that determine the desired strength of the yarn. This creates a yarn with a genuine twist, which may be ultimately led away through a draw-off channel from the vortex chamber, and wound up, for example, on a tube.

In general, within the meaning of the invention, the term "yarn" is understood to be a fiber composite, for which at least a part of the fibers is wound around an internal core. Thus, this comprises a yarn in the conventional sense, which may be processed into a fabric, for example with the assistance of a weaving machine. However, the invention also relates to air spinning machines, with the assistance of which so-called "roving" (another name: coarse roving) may be produced. This type of yarn is characterized by the fact that, despite a certain strength, which is sufficient to transport the yarn to a subsequent textile machine, it is still capable of drafting. Thus, the roving may be drafted with the assistance of a drafting device, for example the drafting unit, of a textile machine processing the roving, for example a ring spinning machine, before it is ultimately spun.

In the processing of synthetic fibers, such as polyester, or mixtures of natural and synthetic fibers, deposits arise, in particular on the surface of the yarn formation element. The reason for this is the fact that the production of synthetic fibers comprises a so-called "preparation of continuous fibers" during the production process. Preparation agents, usually an oil with various additives, are applied at the continuous fibers; this enables a treatment such as, for example, drafting the continuous fibers at high speeds. Such preparation agents sometimes adhere to the synthetic fibers even during the further treatment, and lead to impurities in the air spinning machine.

Typically, a fiber guide element is arranged in the entrance area of the spinning nozzle; through this, the fiber composite is led into the spinning nozzle and finally into the area of the yarn formation element. As yarn formation elements, the majority of spindles are used with an internal draw-off channel. At the top of the yarn formation element, compressed air is introduced through the housing wall of the spinning nozzle in such a manner that the specified rotating vortex air flow arises. As a result, individual external fibers are separated from the fiber composite leaving the fiber guide element and are turned over the top of the yarn formation element. In the further process, these removed fibers rotate on the surface of the yarn formation element. Following this, through the forward movement of the internal core fibers of the fiber composite, the rotating fibers are wound around the core fibers and thereby form the yarn.

However, through the movement of the individual fibers over the surface of the yarn formation element, deposits also form on the yarn formation element because of adhesions on the fibers from the production process. For the same reasons, deposits may also occur on the surface of the interior of the spinning nozzle or the fiber guide element. Such adhesions lead to deterioration of the surface condition of the yarn formation element, and cause a deterioration in the quality of the yarn produced. Therefore, regular cleaning of the affected surfaces is necessary in order to maintain the consistent quality of the spun yarns.

The surfaces of the yarn formation element, the interior of the spinning nozzle, and the fiber guide element may be cleaned manually through a periodic disassembly of the yarn formation element, but this leads to a substantial maintenance effort, coupled with a corresponding interruption in operations.

By contrast, EP 2 450 478 discloses a device that enables an automatic cleaning without stopping the machine. For this purpose, an additive is mixed with the compressed air used for the formation of vortex air flow within the spinning nozzle. The additive is guided through the compressed air on the yarn formation element, and results in the cleaning of the surface of the yarn formation element.

JP-2008-095-208 discloses an additional version for cleaning of the yarn formation element. An additive is also fed to the compressed air used for the swirling in the spinning nozzle, and with such compressed air, is led into the spinning nozzle, and thus to the yarn formation element. In the disclosed version, the dosage and the addition of the additive is separately provided for each spinning unit.

In addition, feeding the additive to the fiber composite, in order to improve the properties of the yarn produced from it, with regard to (for example) its hairiness, strength, elongation and yarn uniformity, is known, whereas the dosage should be very precisely adjustable, in order to prevent more than or less than the indicated target additive quantity from being applied to the individual sections of the fiber composite.

In particular, in practice—regardless of the particular purpose of the addition of the additive—the specified dosage is not always without problems, since the additive is fed to the respective spinning unit with very small volume flows or mass flows, as the case may be.

SUMMARY OF THE INVENTION

Therefore, a task of the present invention is to propose a method and an air spinning machine, with the assistance of which a particularly precise and reproducible dosage of an additive is made possible. Additional objects and advantages of the invention will be set forth in part in the following description, or may be obvious from the description, or may be learned through practice of the invention.

The tasks are achieved by a method and an air spinning machine with the characteristics described and claimed herein.

In accordance with the invention, the method for operating an air spinning machine is characterized by the fact that a liquid additive is used, whereas the additive is degassed prior to leaving the additive supply. The additive supply preferably comprises a line system, which is connected to an additive tank, through which the additive is fed to the individual spinning units. The additive tank may comprise, for example, a container that is partially filled with additive, in which additional compressed air can be present, such that the additive is moved through the line system by the air pressure present in the container. Furthermore, the additive supply preferably comprises individual additive nozzles or other openings fed by the line system with additive, through which the additive leaves the additive supply and at the fiber composite, the yarn produced therefrom, reaches individual areas of the spinning unit (such as the yarn formation element or the fiber guide element) or the air nozzles. In any event, it is provided that the additive is partially or completely freed from gas present in the additive, before it leaves the additive supply. This reliably prevents fluctuations of the volume flow or mass flow, as the case may be, of the additive leaving the additive supply, since the additive stream is not interrupted by gas bubbles forming in the additive supply. Preferably, at least 80%, preferably at least 90%, more preferably at least 95%, of the gas present in the additive prior to the degassing is removed during the degassing, such that, upon leaving the additive supply or upon passing through the aforementioned openings, the additive contains as little gas as possible or no gas at all.

Moreover, it is advantageous if, during the production of yarn, one additive is fed, at least temporarily, to each of the spinning units or at least a large part of them, whereas each spinning unit preferably comprises at least one own dosing unit, which is a part of the additive supply of the air spinning machine and through which the additive leaves the additive supply in a defined mass flow or volume flow, as the case may be. In particular, the additive should, in this case, be degassed prior to reaching the area of the respective dosing unit.

In essence, the invention provides that the gas dissolved in the additive that is used is removed from the additive as much as possible, in order to ensure a constant dosing of the additive when leaving the additive supply or passing through the corresponding dosing unit.

In particular, it is advantageous if the additive is degassed with the assistance of a degassing device of the air spinning machine, and thus in situ. The additive is thus filled into the additive supply, preferably into the aforementioned additive tank, and is then degassed only by means of the air spinning machine itself; that is, it is freed as comprehensively as possible from the gas dissolved in the additive. With respect to possible characteristics of the degassing device that is used, reference is made to the following description. In particular, the additive should be degassed only shortly prior to leaving the additive supply or shortly prior to passing through the corresponding dosing unit, as the case may be. For example, it would be conceivable for the additive to be degassed and to leave the additive supply at the latest after one hour, preferably at the latest after 15 minutes, and to impinge on the yarn, the fiber composite or one or more sections of the spinning unit.

In addition to the spinning nozzle, the spinning unit preferably comprises a drafting unit upstream of the spinning unit for drafting the fiber composite, a draw-off device downstream of the spinning unit for drawing off the yarn from the spinning nozzle and a winding device for winding the yarn. Preferably, all spinning units are constructed identically.

It is also highly advantageous if the additive is degassed at a central point, and is then forwarded to the individual spinning units. In this case, the air spinning machine must feature only one degassing device, with the assistance of which the additive fed to the spinning units can be degassed. It is, of course, also possible to use a multiple number of degassing devices, which are distributed across the spinning unit or are all arranged at one point, whereas a degassing device preferably degasses the additive for several spinning units.

It is also advantageous if the additive is degassed by subjecting it to negative pressure. For example, the absolute pressure within the specified additive tank could be reduced below 1 bar, preferably below 0.8 bar, in order to effect the degassing of the additive. It would also be possible to integrate a degassing device into the specified line system of the additive supply, which contains at least one semipermeable membrane, which is permeable for the gas present in the additive, but which is impermeable for the corresponding liquid fraction of the additive. If a pressure that is smaller than the pressure acting on the additive is then applied to the side of the membrane opposite to the additive, the gas molecules leave the additive and migrate through the membrane to the side of the additive turned away from the additive. The additive can therefore be passed through a semipermeable membrane, which comes into direct contact with the additive, whereas the side turned away from the additive is exposed to a pressure that is lower than the side turned towards the additive. Due to the pressure difference, the degassing of the additive finally occurs, whereas the exiting gas can leave the degassing device through the membrane.

Alternatively or additionally, it is also conceivable that an existing substance, preferably a powder or liquid, is added to the additive, in order to expel the gas dissolved therein from the additive; that is, to degas the additive. For example, it would be conceivable to add sodium sulfite ($Na_2SO_3$) to the additive, preferably at a central location (that is, prior to the splitting of the additive to the individual spinning units), in a concentration of between 0.1 gram per liter of additive and 1.0 gram per liter of additive. Likewise, degassing with the assistance of ultrasound or the heating of the additive would be conceivable, since this also allows the gas contained in the additive to be expelled from the additive.

It is advantageous if at least a part of the additive is fed to the degassing device multiple times before it is forwarded to the spinning units. As a result, the quantity of gas removed from the additive can be increased when compared to a likewise possible method, with which the additive only passes through the additive degassing one time. Ultimately, it is also conceivable for a part of the additive fed to the additive supply to be fed to the spinning units after a one-time degassing, while another part of the additive passes through the degassing device several times.

It is also advantageous if at least a part of the additive present in the additive supply circulates within a ring line system of the additive supply of the air spinning machine, until it is fed to one of the spinning units. Several supply lines can be branched from the ring line system, which lines ultimately connect the ring line system to the individual spinning units. If an additive molecule now passes through one of the supply lines without reaching it (for example, since there is currently no need for additive at the corresponding spinning unit and thus no additive consumption), it is further transported in the ring line system until it enters into one of the subsequent supply lines and can finally be fed to the spinning unit connected with it.

Preferably, the additive is kept continuously in motion during the operation of the air spinning machine within the ring line system; that is, with the assistance of a pump arrangement and/or by means of an excess pressure prevailing in the additive tank, it is transported through the additive supply, in particular the specified ring line system. It is also advantageous if the additive flows continuously through the degassing device.

It is particularly advantageous if water is used as the additive. It is, of course, also possible to conceive of another liquid, which may be aqueous or oil-based.

The air spinning machine in accordance with the invention, which comprises a multiple number of spinning units, also possesses a degassing device, with the assistance of which the additive that is used can be degassed prior to leaving the additive supply; that is, it is able to be degassed. The degassing device (of which several can also be present) is thus a component of the air spinning machine, such that the additive that is used can be degassed in situ; that is, at or through the air spinning machine itself. The degassing device is formed to remove from the additive at least a part of the gas dissolved in the additive before the additive is fed to the spinning units and is correspondingly dosed there. In this case, the dosing is not impaired by gas present in the additive or gas bubbles formed from this, such that a particularly accurate and reproducible dosing at the individual spinning units is possible.

It is advantageous if the degassing device is formed to subject the additive to negative pressure. Thus, the degassing device is capable of reducing the pressure of an area of the degassing device through which the additive flows, in contrast to the ambient air pressure prevailing in the area of the air spinning machine, such that the gas dissolved in the additive can exit the additive and be discharged. For this purpose, the degassing device preferably comprises a membrane (which may in particular comprise a multiple number of membrane sections), which is impassable for the additive but, is passable for the gas dissolved therein. If the pressure on the membrane side turned away from the additive is then reduced compared to the pressure on the membrane side turned towards the additive, a pressure gradient is produced, which leads to the gas dissolved in the additive passing through the membrane and thus being removed from the additive. Alternatively, it would also be conceivable for the degassing device to comprise an ultrasonic unit, with the assistance of which the additive can be degassed by means of ultrasound. Finally, the degassing could also take place by heating the additive, whereas, for this purpose, the degassing device should feature a heat source in operative connection with the additive.

It is also advantageous if the degassing device features a dosing device, with the assistance of which a substance can be fed to the additive, which gives effect to a degassing of the additive. The dosing unit can be formed to supply the substance to the additive in a defined quantity (for example, in a defined mass flow). Likewise, it can be sufficient if the dosing device enables only an addition of the substance to the additive, without thereby giving effect to a quantitative dosing. The substance may comprise, for example, the aforementioned sodium sulfite, whereas other substances that give effect to the degassing of the additive can be used.

It is particularly advantageous if the degassing device is integrated into a line system of the air spinning machine, by means of which the additive can be passed to the individual spinning units. The line system preferably comprises one or more main lines that are connected to an additive tank, from which at least one supply line per spinning unit branches off, through which the additive ultimately can be fed to the corresponding spinning unit. In particular, it is advantageous if the additive supply comprises one or more additive tanks integrated into the line system, which are also preferably subjected to an excess pressure, with the assistance of which the additive is conveyed into and through the line system. In addition, the individual supply lines are to feature dosing units (for example, in the form of dosing valves), in order to be able to dose the quantity of the additive fed to the respective spinning unit, individually at the individual spinning units.

It is also advantageous if the line system is formed as a ring line system, such that the additive that is not fed to one of the spinning units can be circulated in one or more of the aforementioned main lines (which are part of the ring line system) until it is fed to one of the spinning units through a supply line branching off from a main line. The degassing device(s) and/or the additive tank(s) are preferably integrated into a main line of the ring line system.

BRIEF DESCRIPTION OF THE DRAWINGS

Further advantages of the invention are described in the following embodiments. The following is shown, in each case schematically.

DETAILED DESCRIPTION

Figure 1:
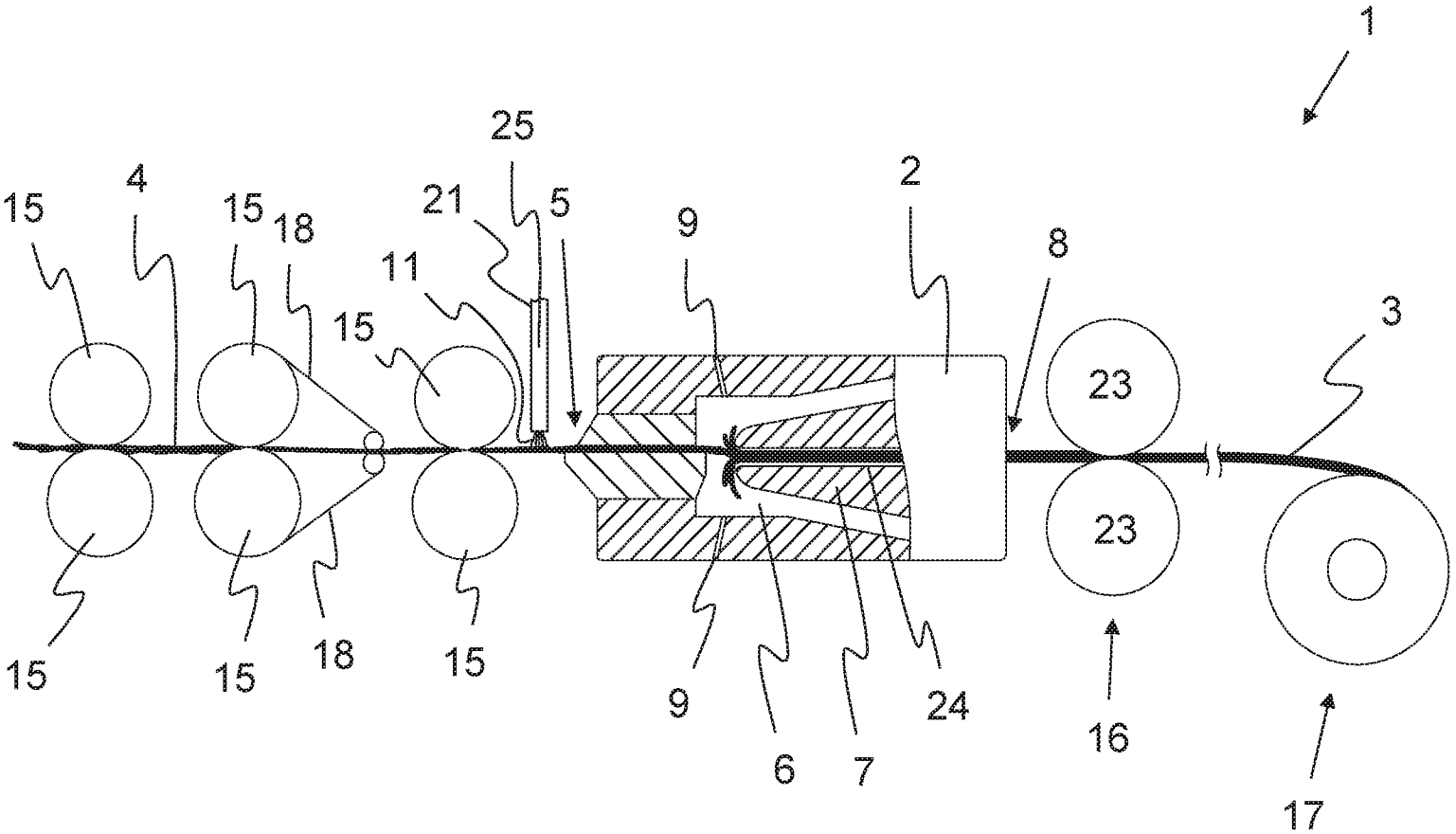
FIG. 1 illustrates a cut-out of a spinning unit of a possible design of an air spinning machine in accordance with the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
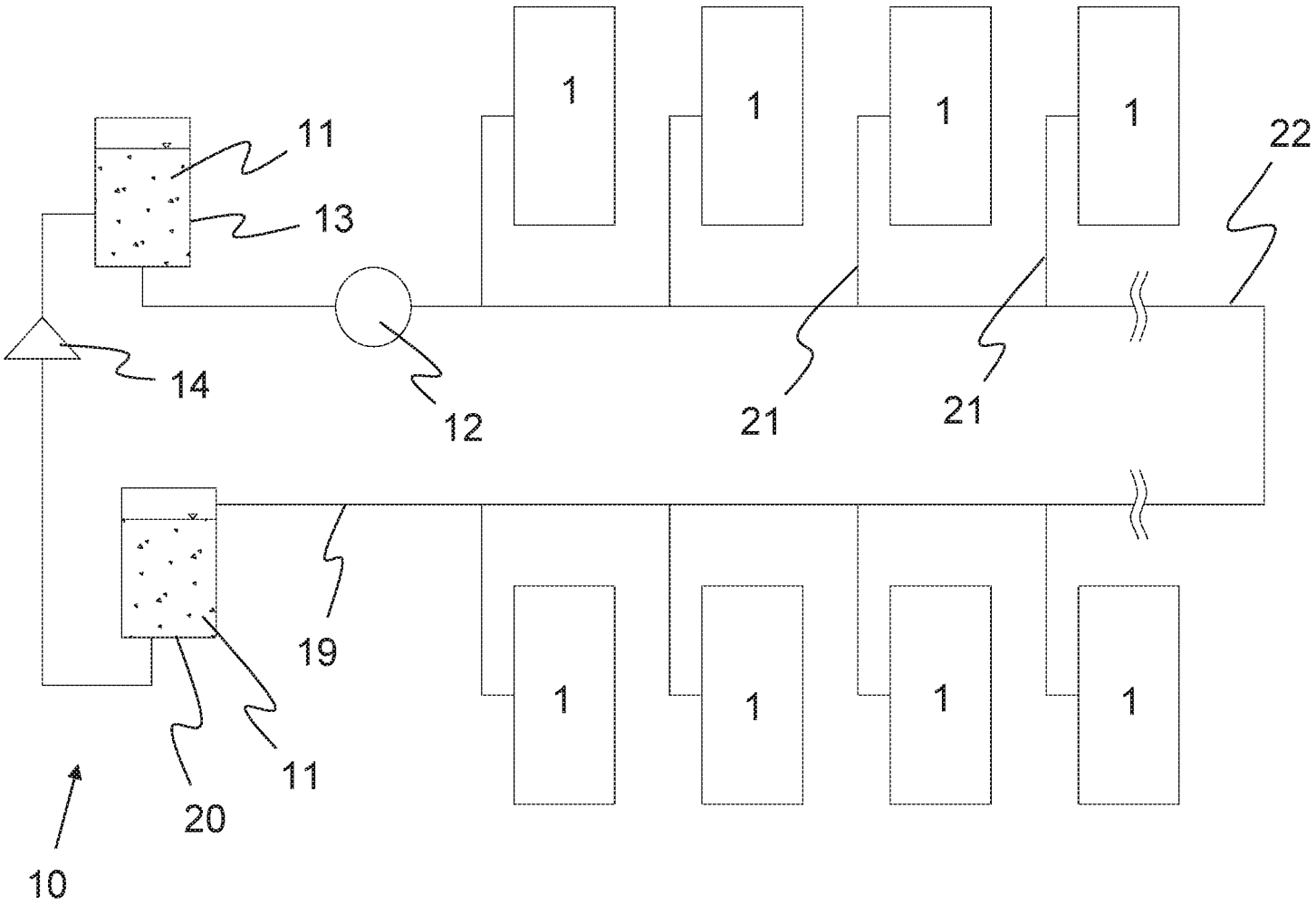
FIG. 2 illustrates selected areas of an air spinning machine in accordance with the invention.

FIG. 1 shows a cut-out of a spinning unit 1 of an air spinning machine in accordance with the invention (whereas the air spinning machine may, of course, feature a multiple number of spinning units 1, as shown in FIG. 2). When required, the air spinning machine may include a drafting unit with several drafting unit rollers 15, (whereas the drafting unit rollers 15 can be partially entwined with an apron 18), which is supplied with a fiber composite 4 in the form of, for example, a doubled drafting sliver. Furthermore, the spinning unit 1 shown includes a spinning nozzle 2, partially cut in FIG. 1, with an internal vortex chamber 6, in which the fiber composite 4 or at least one part of the fibers of the fiber composite 4 is, after passing an inlet 5 of the spinning nozzle 2, provided with a twist (the exact mode of action of the spinning unit 1 is described in more detail below).

In addition, the air spinning machine may include a draw-off device 16 downstream of the spinning nozzle 2 which draw-off device 16 comprises, for example, two draw-off rollers 23, along with a winding device 17 downstream of the draw-off device 16 for the winding of the yarn 3 leaving the spinning unit 1 onto a tube. The spinning unit 1 in accordance with the invention need not necessarily feature a drafting unit. Moreover, the draw-off device 16 is not absolutely necessary.

Generally, the spinning unit 1 shown works according to an air spinning process. For the formation of the yarn 3, the fiber composite 4 is guided into the vortex chamber 6 of the spinning nozzle 2 through the specified inlet 5. At that point, it receives a twist; that is, at least a part of the free fiber ends of the fiber composite 4 is captured by a vortex air flow that is generated by air nozzles 9 correspondingly arranged in a vortex chamber wall surrounding the vortex chamber 6. At this, a part of the fibers is pulled out of the fiber composite 4 at least to some extent, and wound around the top of the yarn formation element 7 protruding into the vortex chamber 6. Given that the fiber composite 4 is extracted through a draw-off channel 24 arranged within the yarn formation element 7, out of the vortex chamber 6, and finally through an outlet 8 out of the spinning nozzle 2, the free fiber ends are also ultimately drawn in the direction of the inlet mouth of the yarn formation element 7 and thereby, as so-called "winding fibers", loop around the core fiber running in the center—resulting in a yarn 3 with the desired twist. The compressed air introduced through the air nozzles 9 leaves the spinning nozzle 2 ultimately through the draw-off channel 24 along with an air outlet that might be present, which, when required, may be connected to a vacuum power source.

In general, it must be clarified at this point that the produced yarn 3 generally comprises any fiber composite 4, which is characterized by the fact that an external part of the fibers (so-called "winding fibers") is looped around an internal part of the fibers that is preferably untwisted or, where required, twisted, in order to impart the desired strength on the yarn 3. The invention also comprises an air spinning machine, with the assistance of which a roving already described in more detail above may be produced.

In accordance with this invention, the air spinning machine now features an additive supply 10, through which an additive 11 can be fed to the individual spinning units 1. For this purpose, each of the spinning units 1 is preferably assigned with a separate dosing unit 25, which is illustrated in FIG. 1 as the end section of a supply line 21, whereas the supply line 21 preferably branches off from a main line 22 of the additive supply 10 (see FIG. 2, in which, for the sake of clarity, only two of the eight supply lines 21 shown are provided with a reference sign). With the assistance of the dosing unit 25, which may include, for example, a valve to be passed through by the additive 11, the quantity of the additive 11 that is fed per unit of time to the spinning unit 1, which in principle comprises a liquid, can be determined.

Furthermore, the additive supply 10 is to comprise one or more additive tanks 13 that provide the additive 11, along with one or more main lines 22 that are connected to it or them, and from which the individual supply lines 21 are branched off (see FIG. 2). The additive tank 13 may comprise a container in which the additive 11 is provided and in which an excess pressure prevails, with the assistance of which the additive 11 from the additive tank 13 is pressed into the respective main line 22.

As can now be seen in FIG. 2, the additive tank 13 is preferably arranged at a location spaced apart from the spinning nozzles 2 (for example, on a carrier or a frame element of the air spinning machine). In addition, the main line 22 may be part of a ring line system 19, through which the individual additive molecules circulate, until they reach one of the supply lines 21 and are ultimately fed to the respective spinning unit 1.

In addition, a collecting tank 20 for the additive 11, which flows back after passing through the main line(s) 22, can be present in the ring line system 19, in which the additive 11 collects and from which it is ultimately withdrawn with the assistance of a pump 14, in order to be newly fed to an additive tank 13.

In order to ensure that the additive 11 that is fed to the individual spinning units 1 contains as little gas as possible or, in the ideal case, no gas at all, the invention provides that the additive 11 is degassed prior to leaving the additive supply 10 and prior to reaching the corresponding dosing unit 25 (if present); that is, it is completely or at least partially freed from the gas present in the additive 11. While the degassing may also take place separately (that is, without the involvement of a device specific to the air spinning machine, a solution with which the degassing device 12 is a part of the air spinning machine, as shown (for example) in FIG. 2, is preferred.

With respect to possible arrangements of the degassing device 12, reference is made to the previous description. In any event, the degassing device 12 should be integrated into a main line 22 of the additive supply 10, such that the additive 11 is degassed before it reaches one of the supply lines 21.

The degassing device 12 is preferably flowed through by the additive 11 and is degassed upon passing through the degassing device 12. In particular, the additive 11 should continuously pass the degassing system upon the operation of the air spinning machine, in order to avoid deposits within the degassing device 12. The degassing device is preferably arranged between an additive tank 13 and a first supply line 21 branching off from the main line 22 in relation to a direction of flow of the additive 11.

This invention is not limited to the illustrated and described embodiments. Variations within the patent claims, such as any combination of the described characteristics, even if they are illustrated and described in different parts of the description or the claims or in different embodiments.

LIST OF REFERENCE SIGNS

1. Spinning unit
2. Spinning nozzle
3. Yarn
4. Fiber composite
5. Inlet
6. Vortex chamber

7. Yarn formation element
8. Outlet
9. Air nozzle
10. Additive supply
11. Additive
12. Degassing device
13. Additive tank
14. Pump
15. Drafting unit roller
16. Draw-off device
17. Winding device
18. Apron
19. Ring line system
20. Collecting tank
21. Supply line
22. Main line
23. Draw-off roller
24. Draw-off channel
25. Dosing unit

The invention claimed is:

1. A method for operating an air spinning machine having a plurality of spinning units, wherein each spinning unit comprises a spinning nozzle with an internal vortex chamber, comprising:

feeding a fiber composite to the spinning nozzle through an inlet during operation of the spinning unit, the spinning nozzle comprising a plurality of air nozzles leading into the vortex chamber;

streaming compressed air streams into the vortex chamber through the air nozzles to generate a vortex air flow within the vortex chamber, wherein the fiber composite receives a twist from the vortex air flow within the vortex chamber such that a yarn is formed from the fiber composite and leaves the spinning nozzle through an outlet;

with an additive supply system, feeding an additive at least temporarily to a part of the spinning units;

degassing the additive prior to the additive leaving the additive supply system and being fed to the part of the spinning unit;

wherein, for the degassing, the additive is subjected to a pressure of less than 1 bar to degas the additive but sufficient to move the additive to the spinning units; and wherein a dosing unit at each spinning unit controls a quantity of the additive fed to the spinning unit per unit of time.

2. The method according to claim 1, wherein the additive is degassed with a degassing device that is an in situ component of the air spinning machine.

3. The method according to claim 1, wherein the additive is degassed at a common central point prior to being forwarded to all of the individual spinning units of the air spinning machine.

4. The method according to claim 3, wherein the additive is subjected to pressure to degas the additive in a common additive tank.

5. The method according to claim 1, wherein a substance is added to the additive to further degas the additive.

6. The method according to claim 1, wherein the additive is fed multiple times through a degassing device to further degas the additive before the additive is fed to the spinning units.

7. The method according to claim 1, wherein the additive supply system comprises a ring line system through which the additive circulates until being fed to one of the spinning units, the additive degassed by being subjected to the pressure in a common additive tank and further degassed via a degassing device configured in-line in the ring line system.

8. The method according to claim 7, wherein the additive is kept continuously in motion through the ring line system during operation of the air spinning machine.

9. The method according to claim 1, wherein the additive is water.

10. An air spinning machine, comprising:

a plurality of spinning units, each spinning unit further comprising a spinning nozzle that produces a yarn from a fiber composite supplied to the spinning nozzle;

an inlet for the fiber composite;

an inner vortex chamber;

a yarn formation element protruding into the vortex chamber;

an outlet for the yarn produced inside the vortex chamber;

a plurality of air nozzles leading into the vortex chamber, wherein during operation the air spinning machine, compressed air streams from the air nozzles are directed into the vortex chamber to generate a vortex air flow within the vortex chamber;

an additive supply system configured to supply at least a part of each spinning unit with a liquid additive;

a degassing device configured in the additive supply system that is used during operation of the air spinning machine to degas the liquid additive, the degassing device configured to subject the liquid additive to a pressure of less than 1 bar to degas the liquid additive, but is sufficient to move the additive to the spinning units; and a dosing unit at each spinning unit that controls a quantity of the additive fed to the spinning unit per unit of time.

11. The air spinning machine according to claim 10, wherein the degassing device comprises a common additive tank to subject the liquid additive to the pressure to degas the liquid additive.

12. The air spinning machine according to claim 10, further comprising a dosing device configured to add a substance to the liquid additive to further degas the liquid additive.

13. The air spinning machine according to claim 10, wherein the additive supply system comprises a ring line system through which the additive circulates until being fed to one of the spinning units, the degassing device configured in-line in the ring line system.

14. The air spinning machine according to claim 13, wherein the additive is circulated multiple times through the degassing device to until fed to one of the spinning units.

15. The air spinning machine according to claim 10, wherein the liquid additive is water.

* * * * *